United States Patent [19]

Shelton

[11] 4,387,118

[45] Jun. 7, 1983

[54] MINIMIZING VOIDS IN FOAM COATING

[75] Inventor: John H. Shelton, Rocky Mount, N.C.

[73] Assignee: Burlington Industries, Inc., Greensboro, N.C.

[21] Appl. No.: 316,538

[22] Filed: Oct. 29, 1981

[51] Int. Cl.[3] ..... B05D 3/12; B05C 3/18

[52] U.S. Cl. ..... 427/176; 118/407; 118/413; 118/414; 118/415; 427/358; 427/359; 427/428; 427/356

[58] Field of Search ..... 118/407, 413, 414, 415; 425/46, 141; 156/78; 427/355, 356, 358, 359, 373, 428, 176

[56] References Cited

U.S. PATENT DOCUMENTS 1,909,482 3/1932 Barrett .
2,969,578 1/1961 Lembo .
3,042,989 5/1961 Foley .
3,273,535 10/1964 Krikorian .
3,710,755 1/1973 Hakanson .
4,016,831 4/1977 James et al. .
4,257,343 3/1981 Kullander .

*Primary Examiner*—Michael R. Lusignan
*Attorney, Agent, or Firm*—Cushman, Darby & Cushman

[57] ABSTRACT

A method and apparatus for foam coating a web are provided that allow for easier cleaning, greater versatility of fabric styles without the introduction of voids in the foam backing, and elimination of voids in the foam backing at seams, or within the web length, due to wrinkling or creasing of the fabric. A doctor blade is provided on top of and slightly in front of a roller, and a foam pillow is formed at the top of the roller, with the fabric providing a bottom barrier for the pillow. The fabric is continuously fed passed a slat expander, which removes wrinkles from it, and then immediately into contact with the periphery of the roller, the roller holding the fabric taut. Needle points can be provided on the fabric peripheral surface to facilitate positive holding of the cloth in place.

27 Claims, 4 Drawing Figures

MINIMIZING VOIDS IN FOAM COATING

BACKGROUND AND SUMMARY OF THE INVENTION

The foam coating of webs, particularly the foam coating of fabrics which are ultimately constructed into draperies or the like, has been practiced commercially at least since the early 1960's. Millions of yards of foam coated fabrics are produced worldwide every year utilizing procedures such as shown in U.S. Pat. Nos. 4,016,831 and 3,527,654. While acceptable product is readily produced utilizing such procedures, as commercialization has developed and a wider variety of fabric styles have been utilized, several long-standing problems have been intensified.

Exemplary long-standing problems in the fabric foam-coating field have been as follows: The necessity for shutting down the operation when the back up surface over which the fabric passes becomes contaminated with foam, dirt, etc. The introduction of voids or thin-coated portions as a result of fabric portions having increased thickness due to surface effects passing between the back up surface and doctor blade. And, most serious of all, the introduction of voids into the backing due to creases and wrinkles in the fabric agjacent to seams between adjacent lengths of fabric, or such creases or wrinkles within the web lengths which may be caused by prior processes or operations (such as improper tentering or batching up processes or operations).

According to the present invention, it is possible to overcome each of the above-mentioned problems. According to the invention, the down-time of the equipment is substantially reduced by allowing cleaning of the web back up surface during actual operation; the introduction of voids due to specific variations of fabric thickness are substantially eliminated by allowing a "floating" action of the web-doctor blade system; and the introduction of voids due to creases and wrinkles around seams or within the web length is virtually eliminated by removing wrinkles or creases from the fabric, and holding the fabric taut during coating. Thus, according to the present invention, it is possible to increase production while substantially eliminating waste due to improper coating of portions of the fabric.

According to the present invention, the conventional flat bed surface backing up the fabric web is eliminated, and instead a relatively large diameter roller is utilized to provide a back up for the traveling fabric web. The roller rotates about a horizontal axis, and the doctor blade (for controlling foam coating) is placed vertically above and slightly in front of a vertical line passing through the roller axis of rotation. Sidewalls act with the doctor blade and the traveling web to confine a foam pillow, the traveling web picking up foam from the pillow and then passing between the roller periphery and doctor blade, with the blade controlling foam thickness. By replacing the flat stationary bed with a continuously rotating structure, it is possible to continuously clean the back up surface, as by merely placing a brush, scraper, or the like in contact with the roller periphery at an area of the roller periphery not engaging the fabric web. Also, by mounting the doctor blade in such a manner relative to the rotating drum small variations in fabric thickness at particular points (normally due to the presence of nubs or other surface effects on the face of the fabric) can be readily accommodated, while the thickness of the foam coating is still properly controllable.

The present invention also utilizes a slat expander or the like mounted in front of the roller for removing wrinkles or creases from the fabric as it passes toward the roller. The slat expander is located directly adjacent the roller so that the spacing therebetween is not significantly greater than the minimum required to allow passage of seams therebetween. As the fabric passes from the slat expander to the roller peripheral surface, frictional engagement between the roller peripheral surface and the fabric holds the fabric in the wrinkle or crease-free condition imparted by the slat expander as the fabric subsequently passes to the foam pillow and doctor blade. Depending upon the type of fabric, it may be necessary to provide surface manifestations (such as engraved needle points) on the roller periphery to facilitate holding the fabric taut while in engagement with the roller periphery. In this way, the introduction of voids into the foam coating as a result of wrinkles or creases adjacent fabric seams or within the web length is essentially eliminated. Also, it is possible to avoid warp tension wrinkling on lightweight construction to minimize voids in the foam.

It is the primary object of the present invention to provide a method and apparatus for the foam coating of a web to maximize production and minimize waste. This and other objects of the invention will become clear from an inspection of the detailed description of the invention, and from the appended claims.

DETAILED DESCRIPTION OF THE DRAWINGS

Figure 1:
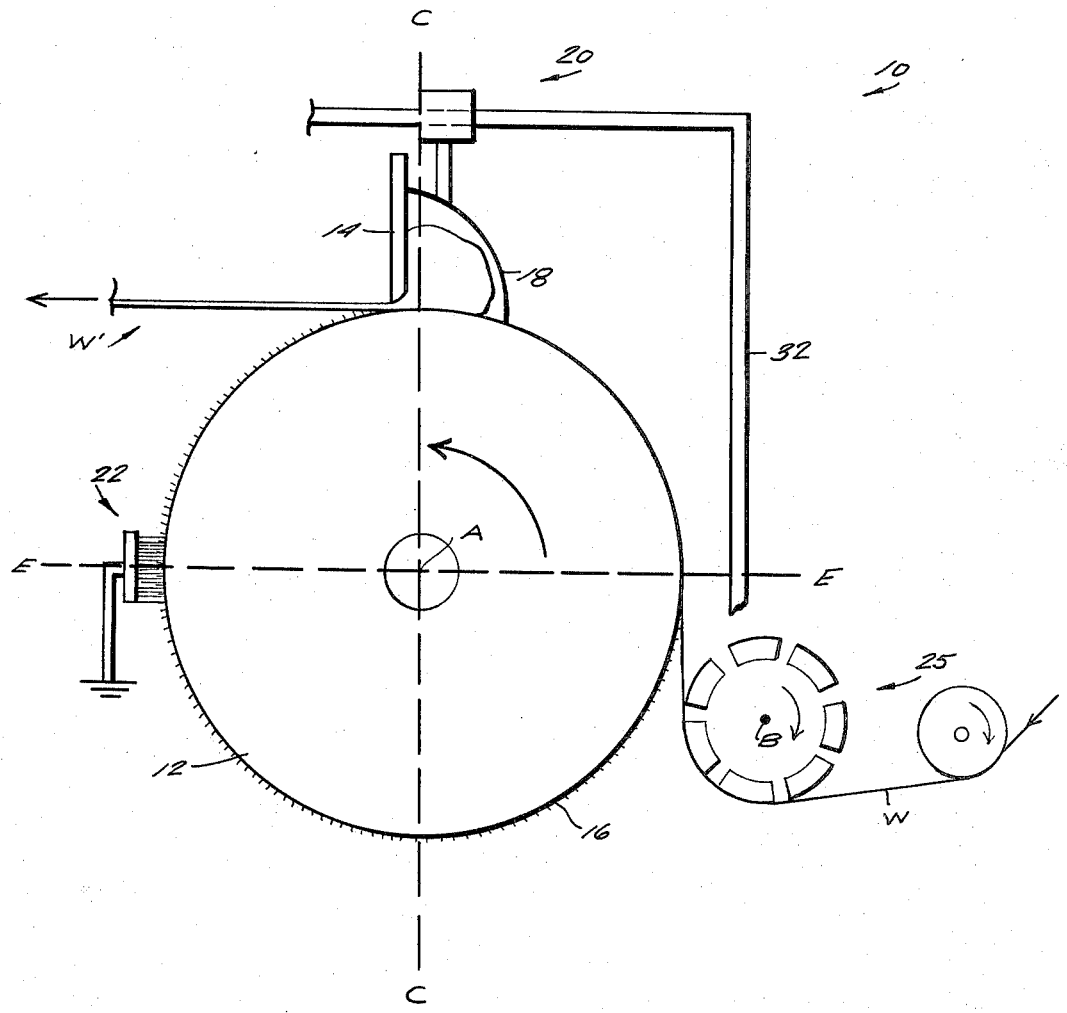
FIG. 1 is a side schematic view of exemplary apparatus according to the present invention.

The exemplary apparatus according to the present invention is illustrated generally by reference numeral 10 in FIG. 1. Major components of the apparatus 10 include a relatively large diameter roller 12 rotatable about a substantially horizontal axis A, and a doctor blade 14 or like coating thickness controlling structure. The roller 12 may have a diameter of about 22 inches, with a stainless steel peripheral surface 16 or the like. It is mounted for rotation about axis A by conventional means, and may be powered or merely an idler, in the latter case rotation being imparted thereto by the force of the moving web W passing in contact therewith.

Figure 3:
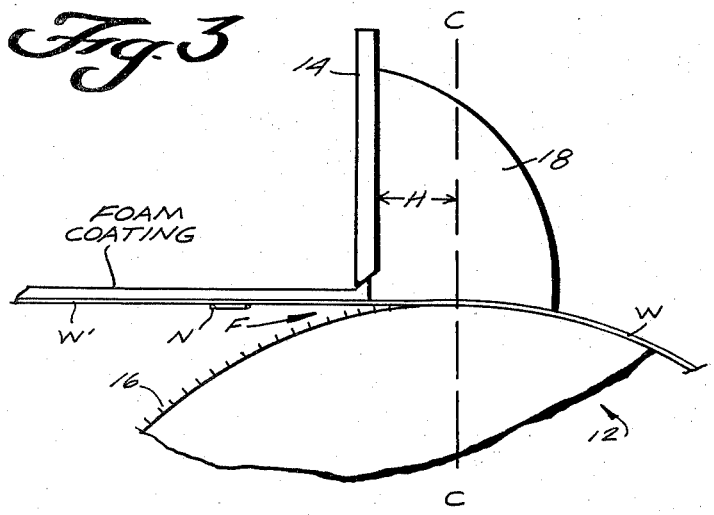
FIG. 3 is a detailed schematic view illustrating the relative positioning between the doctor blade and roller of FIG. 1.

As seen in FIGS. 1 and 3, the doctor blade 14 or the like is mounted vertically above the top of the roller 12, and slightly offset from a vertical line C—C passing through the axis A. The phrase "in front of the roller" as used in the present specification and claims refers to fact that the blade 14 is mounted in front of the line C—C in the direction of movement of the web W, the web W being tangent to the roller 12 substantially at line C—C.

The blade 14 defines the front barrier of a foam pillow that is established at the top of the roller 12. The foam pillow is established and replenished basically in the same manner as disclosed in U.S. Pat. No. 4,016,831 (the disclosure of which is hereby incorporated by reference herein) and the prior art system specifically discussed therein. A pair of arcuate sidewalls 18 (only the far sidewall being visible in FIGS. 1 and 3) are preferably provided for defining the sides of the foam pillow, sidewalls 18 being mounted on appropriate mounting mechanisms—shown generally by reference numeral 20 in FIG. 1—allowing adjustment of the width of the foam pillow. The bottom barrier for the foam pillow is defined by the traveling web W, the foam pillow generally rolling about an axis transverse to the web direction of movement as the web moves therepast, and a portion of the foam clings to the web, the thickness of the foam coating being controlled by the vertical position of the doctor blade 14.

Even though the web W is provided between the foam pillow and the roller periphery 16, after extended operation of the apparatus 10 there is a tendency for some foam to get into the periphery 16, and additionally there can be accumulation of lint, dirt and the like. In prior art arrangements, it was necessary to shut down operation of the apparatus once the backing surface for the web became contaminated. However, due to the fact that the roller 12 is continuously rotating, according to the invention, the frequency between shut-downs can be greatly extended by providing for automatic cleaning of the roller periphery 16 during operation. This may be accomplished by providing a stationarily mounted (although adjustable) brush 22 (or other suitable cleaning apparatus such as a scraping blade) in contact with the roller periphery 16 at a portion thereof where the periphery 16 does not engage the web W.

The relative positioning of the blade 14 with respect to the roller 12—as described above—provides for improved "floating" of the coating system. This may best be seen with respect to FIG. 3 wherein the relative spacing between parts has been exaggerated for clarity of illustration. Since the blade 14 is spaced a distance H from the vertical line C—C passing through axis A, and since the web W is tangent to the roller 12 substantially at line C—C, the web W is not in engagement with the roller periphery 16 when the web W passes under the doctor blade 14. See area F in FIG. 3. Thus, if the face of the fabric web W should have a variation in density at a particular portion thereof, such as by the presence of a nub N or like surface effect, an appropriate thickness of coating will still be applied to the web. (The foam-backed web is indicated by reference letter W' in the drawings.) This allows the apparatus 10 to be utilized with a wide variety of fabric styles without introduction of undersirable voids in the foam coating due to fabric construction and styling.

The foam-coated web W' passes from the doctor blade 14 to a tenter oven or the like. A tenter frame operatively engages the web W side edges and holds the web taut as it is heat treated, ultimately resulting in a desired product.

A further important component of the apparatus 10 according to the invention comprises the slat expander 25, or like means for removing wrinkles and creases from the web W prior to coating. The slat expander 25 is rotatable about substantially horizontal axis B (parallel to axis A), and preferably is made of stainless steel or aluminum. The construction of the slat expander per se is conventional, being generally similar to that described in U.S. Pat. No. 2,969,578. A suitable commercially available slat expander is a 6 inch diameter slat expander roll manufactured by Kay Machine Company of Clifton, N.J.

The slat expander 25 is positioned adjacent the roller periphery 16, behind the roller. The phrase "behind the roller" as used in the present specification and claims indicates a position before the line C—C in the direction of movement of the web W.

Figure 2:
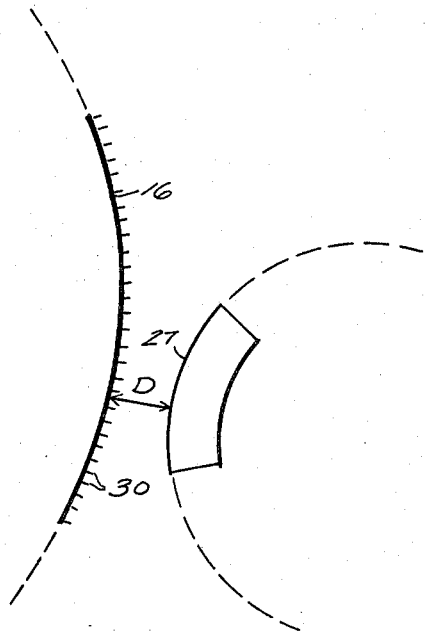
FIG. 2 is a detailed schematic view illustrating the relative positioning between the slat expander and roller of FIG. 1.

As illustrated in FIGS. 1 and 2, the slat expander 25 is positioned very close to the periphery 16 of the roller 12. The positioning must be close enough so that any wrinkles or creases removed by the slat expander 25 do not have an opportunity to re-form prior to the web W moving into contact with the roller periphery 16. This is desirably accomplished by providing a spacing D between the closest points of the roller periphery 16 and the periphery 27 of slat expander 25 that is just large enough to accommodate seams where fabric portions are joined.

After wrinkles and creases are removed by the slat expander 25, the web W is maintained taut so that the wrinkles and creases will not be reintroduced. This is accomplished prior to coating by the frictional engagement between the rotating roller periphery 16 and the fabric web W. For some fabric styles, even if the roller periphery 17 is smooth, sufficient frictional engagement will be provided to hold the web W taut. However, for other fabric styles, some sort of roughening of the periphery 17 is necessary in order to provide the necessary results. Any surface manifestations on roller periphery 16 may be utilized that do not harm the face of the fabric, do not significantly impede cleaning, and provide the necessary holding ability. One example of such surface manifestations comprises spaced engraved needle points 30 (see FIG. 2) formed about the entire periphery 16.

The slat expander 25 is illustrated positioned so that the axis B is below a horizontal line E—E extending through the roller axis A. This is a desirable relative positioning between components since it provides a relatively large arcuate length wherein the web W and roller periphery 16 are in engagement. However, the slat expander 25 may be positioned at any other position as long as the desirable results according to the invention are achieved.

The tension-maintenance of the web W accomplished by the roller periphery 16 is advantageous compared to other possible systems for maintaining the web taut after it is spread or expanded in the width dimension by the slat expander 25. For instance, were a tenter frame to be utilized—engaging the web W at the sides thereof—it would be necessary to provide doctor blades 14 of a wide variety of widths in order to accommodate different fabric widths. This would require substantial down time at each changeover of fabric types, to allow a new doctor blade to be properly positioned. By engaging the web W at the central portions (and essentially along the entire width) thereof, a single doctor blade 14 can be utilized to accommodate any width of fabric. All that need be done to accommodate fabrics of different widths is to change the relative spacing of the sidewalls 18, something that can be readily and even automatically accomplished.

Fabric guides may be provided adjacent the side edges of the web W prior to its engagement with slat expander 25 to guide it. Fabric guides are not illustrated since they are of minor importance and are conventional. It is desirable to hook each fabric guide to a support structure 32, which is operatively connected to the support 20 for a sidewall 18, so that the spacing between the fabric guides automatically changes depending upon the spacing between the sidewalls 18.

Figure 4:
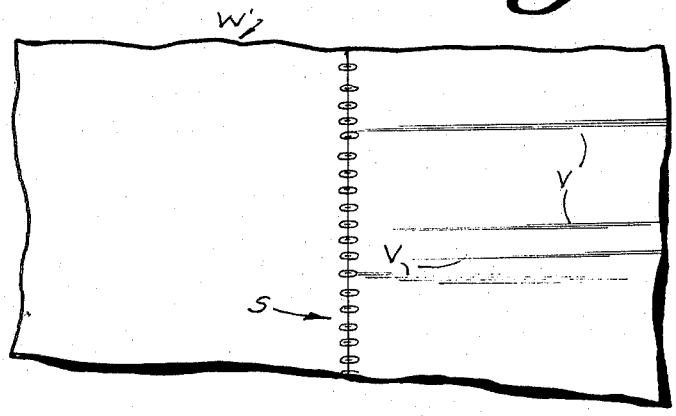
FIG. 4 is a plan view of the foam backing of a portion of fabric adjacent a seam between two fabric lengths.

The advantageous results achievable utilizing the slat expander 25 and roller 12 can be seen by an inspection of FIG. 4, which shows a portion of a coated web W'. The portion of the web illustrated in FIG. 4 includes a longitudinal seam S at the juncture between two lengths of fabric, the seam S normally provided by stitching together fabric lengths, the stitching being accomplished so that any extra material is adjacent the fabric face (i.e. opposite the fabric surface to be coated with foam). The right-hand side of FIG. 4 illustrates what can and very often does occur adjacent the seam S during conventional foam coating. Voids V are introduced into the foam due to wrinkles and creases in the fabric. Such voids V may extend as far as three or four feet from the seam S, and since the voids make the fabric unacceptable, the entire length of fabric containing the voids must be cut out. Commercial foam-coaters have lived with this problem for many years since no solution was known. Even when bow rollers or the like are utilized prior to the coating structure for removing wrinkles from the web, wrinkles and creases usually re-formed prior to actual coating. However, when practicing the present invention, the voids V as a result of wrinkles or creases adjacent seams S, or within the web length, are essentially eliminated. The left-hand side of FIG. 4 illustrates the uniform product produced according to the present invention.

In the practice of the method of foam coating a traveling web according to the present invention utilizing the apparatus 10, the roller 12 continuously rotates about its axis A. A foam pillow is established and maintained (as discussed in U.S. Pat. No. 4,016,831) on top of the roller 12, with the doctor blade 14 providing the front barrier of the foam pillow and the web W the bottom barrier thereof. The web W is continuously fed into contact with the roller periphery 16 so that it passes between the top of the roller 12 and the doctor blade 14 through the foam pillow, the blade 14 or the like establishing the thickness of the foam coat. The roller periphery 16 is continuously cleaned by brush 22 or the like during rotation of roller 12. The final web W' produced is substantially fee of voids due to wrinkles or creases around longitudinal seams, or within the web length, in the feed web W since the slat expander 25, or the like, tensions and expands in the width dimension the web W immediately prior to its passage into contact with the roller periphery 16 (removing the creases and wrinkles), and the fabric is maintained taut by frictional engagement between it and the web periphery 16, which frictional engagement may be facilitated by needle points 30 or the like formed on the roller periphery 16. Should it be necessary to change over fabrics to accommodate a fabric of a different width, this is accomplished merely by adjusting the relative positions between the sidewalls 18, no changing of the doctor blade 14 being necessary.

It will thus be seen that according to the present invention a method and apparatus have been provided which maximize the production of foam-coated fabric, and minimize the waste of fabric, particularly due to voids in the foam coating due to wrinkles or creases around longitudinal fabric seams, or within the web length. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of foam coating a web utilizing a roller rotatable about a substantially horizontal axis of rotation, and a doctor blade positioned slightly vertically above the top periphery of the roller and slightly in front of the roller, comprising the steps of:

(a) continuously rotating the roller about its axis;

(b) establishing and maintaining a foam pillow on top of the roller with the doctor blade providing the front barrier of the foam pillow and the web the bottom barrier thereof; and (c) continuously feeding the web to be coated into contact with the roller periphery so that it passes between the top of the roller and the doctor blade through the foam pillow, the blade establishing the thickness of the foam coat.

2. A method as recited in claim 1 comprising the further step of cleaning the exterior surface of the roller while it is continuously rotating.

3. A method as recited in claim 1 comprising the further steps of:

(d) tensioning the web in the width dimension just prior to the area where it is brought into contact with the roller periphery; and (e) maintaining the web taut during coating thereof.

4. A method as recited in claim 3 wherein (d) is practiced by passing the web into operative engagement with a slat expander.

5. A method as recited in claim 4 wherein (e) is practiced by the substeps consisting of: passing the web into immediate contact with the roller from the slat expander; and frictionally engaging the web with the roller peripheral surface.

6. A method as recited in claim 5 wherein said frictionally engaging substep is facilitated by providing surface manifestations on the roller periphery that allow simple cleaning of the roller, tightly hold the web in place, and do not damage the web.

7. A method as recited in claim 3 wherein steps (d) and (e) are practiced by engaging central portions of the web between the edges thereof.

8. A method as recited in claim 1, 3, 5 or 7 wherein the web is a fabric web.

9. A method of producing from a feed fabric having a plurality of longitudinal seams, a foam-coated fabric free of voids due to wrinkles or creases around the seams, or within the web length, utilizing a roller rotatable about a substantially horizontally axis, comprising the steps of:

(a) continuously rotating the roller about its axis;

(b) establishing and maintaining a foam pillow on top of the roller periphery with the fabric web providing the bottom barrier for the foam pillow;

(c) tensioning the fabric in the width dimension immediately prior to passing it into contact with the roller;

(d) maintaining the fabric taut by frictional engagement between it and the roller periphery; and (e) continuously passing the fabric into operative contact with and past the foam pillow to provide a substantially void-free coated fabric web.

10. A method as recited in claim 9 wherein step (c) is practiced by passing the fabric over a slat expander immediately prior to passing it into contact with the roller periphery.

11. A method as recited in claim 9 or 10 wherein step (d) is facilitated by providing surface manifestations on the roller peripheral surface that effect tight holding of the web in place on the roller periphery while not damaging the web.

12. A method as recited in claim 1 or 9 wherein the web comprises a fabric web having surface effects on the face thereof, opposite the surface being foam-coated.

13. A method of producing from a feed fabric web having a plurality of longitudinal seams a foam-coated fabric web free of voids due to wrinkles or creases around the seams, or within the web length, and utilizing a doctor blade for controlling foam coating, comprising the steps of:

establishing a foam pillow with the doctor blade as the front barrier thereof;

continuously passing fabric web underneath the foam pillow in the doctor blade, with the web providing the bottom barrier of the foam pillow, to effect coating;

tensioning the fabric in the width dimension prior to its passage into operative engagement with the doctor blade and holding the fabric tensioned as it passes past the foam pillow; and changing over from one width fabric to another without changing the doctor blade.

14. Apparatus for foam coating a web comprising:

a roller rotatable about a substantially horizontal axis;

means for defining a foam pillow of a predetermined volume on a web to be backed, including means for confining the front and sides of the pillow with the web supporting the bottom of the pillow, said means positioned vertically above the top periphery of the roller, with the web in engagement with the roller;

means for passing the web past the foam pillow;

means for allowing only a portion of the foam in the pillow to pass with the web as it moves past the pillow; and means for continuously replenishing the foam material in the pillow.

15. Apparatus as recited in claim 14 wherein said means for confining the front of the pillow and said means for allowing only a portion of the foam to pass with the web comprises a doctor blade positioned above the roller and slightly in front of the roller.

16. Apparatus as recited in claim 14 further comprising means for automatically cleaning the roller periphery during rotation thereof.

17. Apparatus as recited in claim 16 wherein said cleaning means comprises a stationarily mounted brush positioned so that the bristles thereof engage the roller periphery at a portion of the roller periphery not in engagement with the web.

18. Apparatus as recited in claim 14, 15, or 17 further comprising surface manifestations formed on the roller periphery for facilitating frictional holding of the web by the roller periphery.

19. Apparatus as recited in claim 14 or 15 further comprising means for tensioning web in the width dimension just prior to the area where it is brought into contact with the roller periphery, and means for maintaining the web taut during passage past the foam pillow.

20. Apparatus as recited in claim 19 wherein said tensioning means comprises a slat expander mounted for rotation about an axis parallel to the axis of rotation of said roller with the periphery thereof adjacent the roller periphery; and wherein said web width-dimension-tension-maintaining means comprises the peripheral surface of said roller.

21. Apparatus as recited in claim 14 further comprising a slat expander rotatable about an axis parallel to the axis of the roller, and positioned behind the roller with the periphery thereof slightly spaced above the roller periphery.

22. Apparatus as recited in claim 21 wherein said slat expander has a diameter significantly smaller than the diameter of said roller.

23. Apparatus as recited in claim 21 or 22 wherein said slat expander is mounted so that the axis of rotation thereof is below the axis of rotation of said roller.

24. Apparatus as recited in claim 21 wherein said roller has a plurality of needle points for engaging the web extending radially from the periphery thereof.

25. Apparatus for coating a web comprising:

a relatively large diameter roller mounted for rotation about a horizontal axis;

a doctor blade mounted vertically above the roller and slightly in front of the roller and providing a front surface defining a reservoir of coating material, the doctor blade spaced from the roller to allow passage of the web between the roller and the doctor blade with the coating material on top of the web; and a relatively small diameter slat expander mounted for rotation about an axis parallel to the roller axis, and positioned behind the roller with the periphery thereof slightly spaced from the roller periphery.

26. Apparatus as recited in claim 25 further comprising a plurality of needle points extending radially outwardly from the roller periphery.

27. Apparatus as recited in claim 25 wherein the roller periphery and the slat expander are made of stainless steel.

* * * * *